United States Patent [19]

Wallwey et al.

[11] 4,096,783

[45] Jun. 27, 1978

[54] MOUNTING FOR AMMUNITION CONTAINERS ON RAPID-FIRE GUN MOUNTS

[75] Inventors: Erich Wallwey; Wolfgang Becker, both of Vellmar; Heinrich Heldmann, Kassel, all of Germany

[73] Assignee: Wegmann & Co., Kassel, Germany

[21] Appl. No.: 747,587

[22] Filed: Dec. 6, 1976

[30] Foreign Application Priority Data

Dec. 12, 1975 Germany ..... 2555126

[51] Int. Cl.[2] ..... F41F 9/06

[52] U.S. Cl. ..... 89/34; 248/313

[58] Field of Search ..... 89/1 R, 33 R, 33 B, 89/33 BA, 33 BB, 33 BC, 34, 36, 37 R, 37 B, 37.5 R, 40 E; 248/311.1, 313

[56] References Cited

U.S. PATENT DOCUMENTS

| | | | |
|---|---|---|---|
| 1,719,147 | 7/1929 | Tansley | 89/33 BB |
| 2,343,863 | 3/1944 | D'Ardenne | 89/1 R |
| 2,397,747 | 4/1946 | Lindsey et al. | 89/33 BB |
| 3,138,994 | 6/1964 | Blunk | 89/37 R |
| 3,788,189 | 1/1974 | Sachleben et al. | 89/34 |

*Primary Examiner*—Stephen C. Bentley

*Attorney, Agent, or Firm*—Burgess, Dinklage & Sprung

[57] ABSTRACT

A mounting for an ammunition container for mounted rapid-fire weapons comprising a yoke disposed on a bracket which yoke is pivotable about a horizontal axis disposed at about the level of the upper edge of the ammunition container to be contained therein, the yoke being secured at its lowermost position by a catch means. Disclosed in the application is such a mounting in which means are provided to urge an ammunition container toward a rapid-fire weapon. Means are also provided to dispose the ammunition container precisely within the mounting, to rapidly remove any container top so as to permit the rapid feed of ammunition into the weapon. A device for insuring that the yoke bears against the ammunition is provided by which inadvertent release of the same is precluded.

10 Claims, 3 Drawing Figures

MOUNTING FOR AMMUNITION CONTAINERS ON RAPID-FIRE GUN MOUNTS

BACKGROUND OF THE INVENTION

1. Field of the Invention

This invention relates to a mounting for an ammunition container for mounted rapid-fire weapons. More especially this invention relates to such a mounting have a bracket on which is disposed a yoke which is pivotable about a horizontal axis lying at approximately the level of the upper edge of an ammunition container to be contained within the mounting. This invention further relates to a catch means disposed to secure the yoke at its lowermost position during use. This invention relates in particular to means for insuring that the catch means is not inadvertently disconnected prior to the time for removal of the ammunition container.

2. Discussion of the Prior Art

In mounted rapid-fire weapons, especially machine guns, from which belted ammunition is fired, the ammunition is taken as a rule from a magazine which is installed on the gun mount and adapted to the gun, and it is fed to the gun through guiding means. The ammunition must therefore be removed from the regular ammunition packing cases and inserted into the magazine of the weapon. This operation is time-consuming.

It is an object of this invention therefore to provide a magazine mounting which enables the fastening of the ammunition packing cases themselves to the gun mount in such a manner that the ammunition can be fed directly to the rapid-fire gun from the packing case. The common ammunition packing cases have a hinged lid which must be opened to remove the ammunition. In the case of unmounted rapid-fire weapons this lid is simply swung aside. However, in the case of mounted weapons there is an insufficient room available to swing the hinged lid aside.

SUMMARY OF THE INVENTION

The problems attendant the feed of ammunition to mounted rapid-fire weapons are solved in accordance with the present invention which broadly comprises a magazine mounting for an ammunition container for rapid-fire weapons which mounting comprises yoke disposed on a bracket, said yoke pivotable about a horizontal axis disposed about the level of the upper edge of an ammunition container to be contained therein, said yoke being secure at its lowermost position by a catch means.

In accordance with the present invention a yoke is provided which is disposed on a bracket for pivoting about a shaft located at approximately the height of the upper edge of the magazine or packing case which is held in its lowermost position by a catch means. The high position of the shaft is advantageous since when the yoke is raised sufficient space is available for the insertion of the ammunition case. When the yoke is depressed the ammunition case is urged against a stop means, generally vertically disposed, to hold the same fast within the magazine mounting.

The conventional ammunition packing cases have appreciable tolerances in respect of their outside dimensions. To compensate for such differences the present invention comprises a cross member or traverse bar suitably in the form of a roller which is spring tensioned. Such a member is advantageously displaceably disposed in the yoke such that when the yoke is depressed the cross member or transverse bar tightly engages the ammunition box under the tension of the springs.

The catch means is preferably pivotable about a shaft, and advantageously is provided on both sides with a hook which engages a stud on the yoke. To prevent the catch means from becoming accidentally disengaged—say by an accidental collision with the operating lever, the operating lever is best fastened so as to be able to be tilted on the pivot shaft transversely of the pivoting movement, so that, in the locked position, a stud provided on it is caught by a stop means. Furthermore, a ramp surface is advantageously provided on the pivoted yoke, and, upon the pivoting of the catch means lever from the locked position to an open position, is encountered by a stud or the like disposed on the lever, so that the yoke is forced upwardly. As a result, as soon as the catch means is released, the yoke also swings upwardly and releases the ammunition box, so that the latter can be immediately removed and replaced with a new box.

To enable the cover of the ammunition box to be held open after insertion, a rest for the cover can furthermore be provided on the upper part of the bracket. On the pivoted yoke still another holding yoke can be provided, which engages the top of the cover when the yoke is depressed. Furthermore, an additional compression spring can be provided to urge the yoke upwardly.

To hold the ammunition box in the correct position, stop means can be disposed on the bracket for the box, and for the feeding of the ammunition a surface for the guidance of the ammunition belt can also be provided on the bracket.

BRIEF DESCRIPTION OF DRAWINGS

An embodiment of the mounting in accordance with the invention is represented in the drawings appended hereto, wherein.

DESCRIPTION OF SPECIFIC EMBODIMENTS

Figure 1:
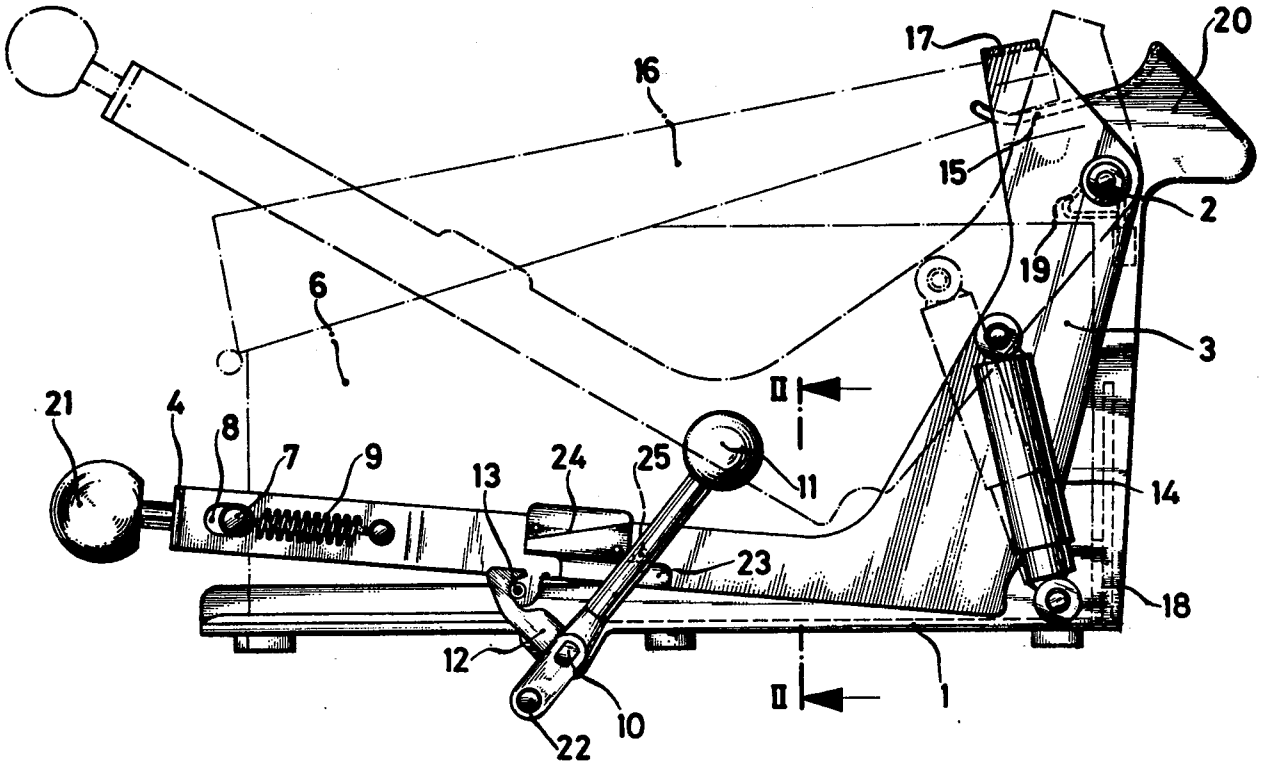
FIG. 1 is a side elevational view of the mounting.

A bracket 1 can be fastened to the gun mount, which is not shown. On this bracket there is disposed, for pivoting about an axis 2, the yoke 3 which consists of two arms joined by a transverse member 4. The ammunition box 6 is represented by the dash-dotted lines. Since these boxes differ in length from one another, openings 8 are provided on both sides in the yoke 3, into which a rod or a roller 7 can be inserted, which is urged against the ammunition box 6 by the springs 9 provided on both sides, when the yoke 3 is depressed.

Figure 2:
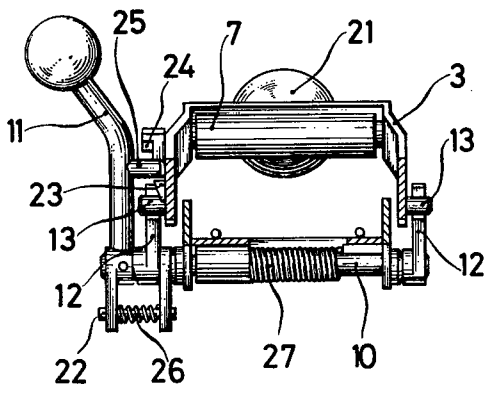
FIG. 2 is a cross sectional view taken through this mounting along line II—II of FIG. 1.
Figure 3:
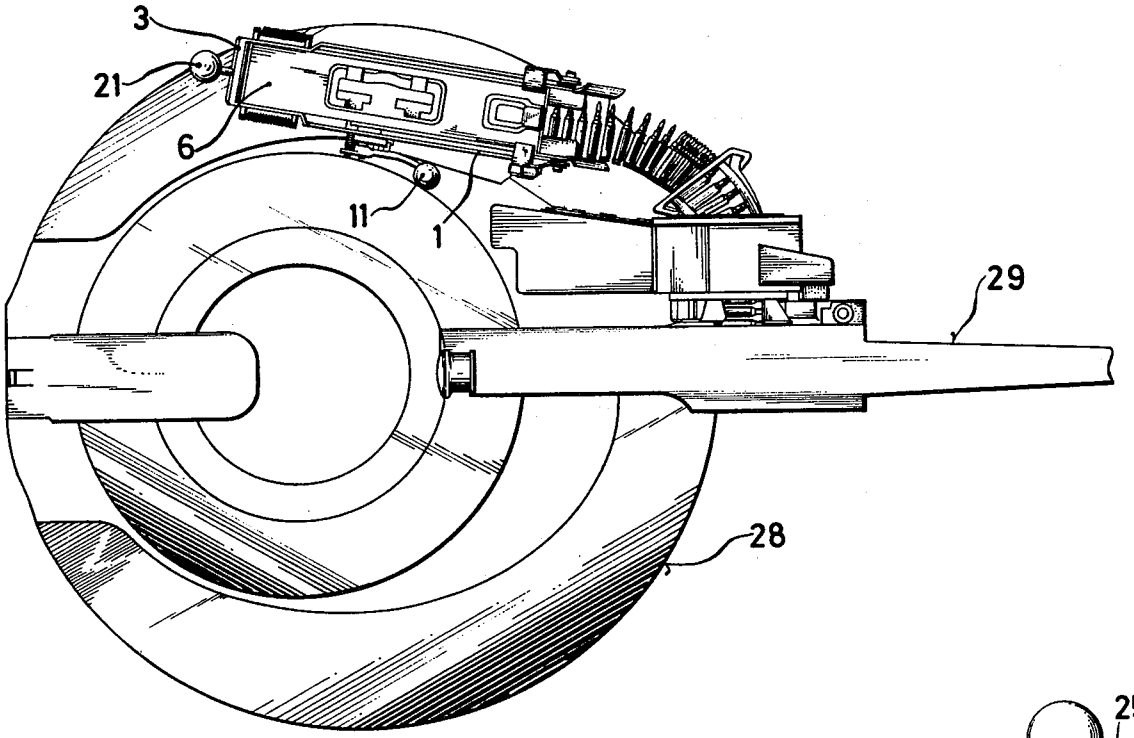
FIG. 3 is a plan view showing the apparatus of FIG. 1, showing the relationship of the apparatus to the gun mount 28 and the gun 29.

The catch means is pivoted on an axis 10, and can be released by means of the handle 11. The catch means has, at least on one side, and desirably on both sides, a hook 12 which engages a stud 13 on the yoke 3. To prevent the catch means from being released unintentionally, the lever 11 is so fastened to the pivot shaft 10 that it can be tilted slightly outwardly, this tilting movement acting against a compression spring 26 disposed on a stud 22. A stud 25 is affixed to the lever 11, and a stop block 24 is disposed on the yoke 3. The stop block 24 consists of two steps, the upper step having a ramp surface on its underside. In the locking position, the stud 25 is located in back of the stop block 24, so that the catch means cannot be released until after the level 11 has been tilted slightly outwardly, i.e., to the left in FIG. 2. so that the stud is no longer in back of the stop block 24. The lever 11 can now be pivoted about the pivot shaft 10, whereupon the hook 12 disengages itself from the stud 13, on the one hand, and on the other hand the stud 25 encounters the ramp surface of stop block 24 and thus forces the yoke 3 upwardly.

In this manner, the friction between roller 7 and the ammunition box is overcome and all gripping of any kind is released, so that a compression spring 14 disposed between the bracket and the yoke 3 can force the yoke upwardly far enough to permit the ammunition box 6 to be removed and replaced with another in a convenient manner. The stud 25 thus serves the dual purpose, on the one hand of securing the operating lever 11 in the locking position, and on the other hand of forcing the yoke 3 upwardly by cooperating with the ramp surface on the stop block 24. Of course, two separate means could also be provided on lever 11 for this purpose. By means of a spring 27 on pivot shaft 11, the lever 11 is returned to the locking position.

On the bracket 1 there is a support 15 by which the cover 16 of the inserted ammunition box is held open sufficiently for the ammunition belt to be delivered to the gun through the belt guide 19–20. On the pivoting yoke 3 there is provided above the support 15 a holding yoke 17 which, when yoke 3 is depressed by means of the handle 21, performs a pivoting movement to the left in FIG. 1, so that it secures the cover 16 on the support 15. On the bracket 1 there are furthermore provided stops 18 and 19, stop 18 preventing the longitudinal displacement of the ammunition box which is urged by the spring 9 against the stop 18, and stop 19 preventing the ammunition box from riding upwardly.

The replacement of the ammunition box is performed in the following manner:

The lever 11 is tilted outwardly and pivoted on the axis 10, thereby releasing the catch means 12–13 and raising yoke 3 upwardly, whereupon the yoke, after the friction resistance has been overcome, is raised further upwardly by the spring 14. The empty ammunition case is thus released and can be removed from the mounting. The new ammunition box is opened prior to insertion, the leading end of the belt is taken out, and the box is pushed into the mounting. With the cover 16 still open, the leading end of the belt can be introduced over the ramp surface 19 into the belt guide 20. The cover is then closed to the extent that it rests upon the support 15, and the yoke 3 is pushed downwardly by means of the handle 21 until the hook 13 is engaged. In this rocking movement of the yoke, the crossbar 7 is forced against the back of the ammunition box so that the box is gripped between this cross bar and and stops on the bracket, while on the other hand the yoke 17 is pushed over the cover 16 so that the cover, too, is secured in its correct position.

If a new box is not inserted, the yoke can be lowered until it is engaged by the catch means. Since only one handle 21 has to be operated upon the insertion of the ammunition box and only one handle 11 has to be operated upon its removal, the ammunition box mounting can be operated with one hand, so that the second hand is free for the insertion of the box and for the threading of the ammunition belt.

What is claimed is:

1. A mounting for an ammunition container for mounted rapid-fire weapons comprising a yoke disposed on a bracket, said yoke pivotable about a horizontal axis disposed at about the level of the upper edge of an ammunition container to be contained therein, said yoke being secured at its lowermost position by a catch means and consisting of a pair of laterally running, parallel arms joined by a transverse member.

2. A mounting for an ammunition container according to claim 1 wherein said yoke carries a spring biased cross member said cross member biased toward an ammunition container to be disposed therein.

3. A mounting for an ammunition container according to claim 1 wherein said catch means is pivotably disposed about a horizontal axis, said catch means is disposed on at least one lateral side of said bracket and comprises a hook which engages a stud on said yoke.

4. A mounting for an ammunition container according to claim 3 wherein said catch means further comprises a lever fastened pivotally to a pivot axis and is disposed thereon so as to be transversely movable with respect to the pivotal direction.

5. A mounting for an ammunition container according to claim 4 wherein on said yoke there is disposed a ramp surface onto which a stud disposed on said lever runs when said lever is moved from said locking position to the open position whereby to forcibly move said yoke upwardly.

6. A mounting for an ammunition container according to claim 1 wherein said bracket comprises a horizontal portion to which said yoke is attachable and a vertical portion, said vertical portion having a protruding lip running generally parallel to said horizontal portion, whereby when an ammunition container having a top is inserted in said bracket and engaged by said cross member said lip holds said top in open position.

7. A mounting for an ammunition container according to claim 6 wherein disposed over said lip and affixed to said yoke there is a holding yoke also pivotal about the horizontal axis about which said yoke was pivotal whereby when said yoke is pivoted said holding yoke engages the top of an opened ammunition container to hold the same in open condition against said container.

8. A mounting for an ammunition container according to claim 1 wherein said yoke is mounted to said bracket via a compression spring which urges said yoke upwardly away from said bracket.

9. A mounting for an ammunition container according to claim 8 wherein there is a vertically disposed longitudinal stop on said bracket for engagement by an ammunition container.

10. A mounting for an ammunition container according to claim 6 wherein said vertical portion carries a height stop for engagement with an ammunition container, said height stop being generally parallel to said horizontal portion and having at its outer edge an upwardly ascending slide surface whereby when a container with a top engages said height stop at the junction of said container and said top said top will be partially removed.

* * * * *